US009514680B2

(12) United States Patent
Liu et al.

(10) Patent No.: US 9,514,680 B2
(45) Date of Patent: Dec. 6, 2016

(54) OLED PIXEL DRIVING CIRCUIT WITH COMPENSATION CIRCUITRY FOR UNIFORM BRIGHTNESS

(71) Applicant: AU OPTRONICS CORP., Hsin-Chu (TW)

(72) Inventors: Li-Wei Liu, Hsin-Chu (TW); Wei-Chu Hsu, Hsin-Chu (TW); Yung-Chih Chen, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 113 days.

(21) Appl. No.: 14/587,589

(22) Filed: Dec. 31, 2014

(65) Prior Publication Data

US 2015/0294624 A1 Oct. 15, 2015

(30) Foreign Application Priority Data

Apr. 9, 2014 (TW) ..... 103113080 A

(51) Int. Cl.
*G09G 3/3233* (2016.01)
*G09G 3/32* (2016.01)

(52) U.S. Cl.
CPC ..... *G09G 3/3233* (2013.01); *G09G 2230/00* (2013.01); *G09G 2300/0819* (2013.01); *G09G 2300/0852* (2013.01); *G09G 2300/0861* (2013.01); *G09G 2320/0233* (2013.01); *G09G 2320/045* (2013.01)

(58) Field of Classification Search
CPC ..... G09G 3/3233; G09G 2320/045; G09G 2320/0233; G09G 2300/0852; G09G 2300/0861;G09G 2230/00; G09G 2300/0819
See application file for complete search history.

(56) References Cited

U.S. PATENT DOCUMENTS

2004/0227706 A1* 11/2004 Sung ..... G09G 3/3233 345/76
2009/0309516 A1* 12/2009 Kim ..... G09G 3/3233 315/307

(Continued)

FOREIGN PATENT DOCUMENTS

CN 102820001 12/2012

OTHER PUBLICATIONS

China Patent Office, "Office Action," Jul. 31, 2015.

*Primary Examiner* — Larry Sternbane
(74) *Attorney, Agent, or Firm* — WPAT, PC; Justin King

(57) ABSTRACT

A pixel driving circuit includes a light emitting diode (LED), a data writing unit, two transistors and two compensation units. The gate of the first transistor is coupled to the data writing unit for determining the current flow of the LED. The first compensation unit is coupled to the first transistor for providing a current path from the gate of the first transistor to a first voltage source and a current path from the gate of the first transistor to a second voltage source. The second compensation unit includes a first capacitor coupled to the gate of the first transistor for voltage coupling and providing a differential voltage that equals to the OLED to the gate of the first transistor. The second transistor is coupled between the first voltage source and a second voltage source for enabling or disabling the current flow between the first and second voltage sources.

17 Claims, 7 Drawing Sheets

(56) References Cited

U.S. PATENT DOCUMENTS

| | | | | |
|---|---|---|---|---|
| 2009/0309816 | A1* | 12/2009 | Choi | G09G 3/3233 345/76 |
| 2010/0053233 | A1* | 3/2010 | Ishiguro | G09G 3/3233 345/690 |
| 2010/0253608 | A1 | 10/2010 | Kim et al. | |
| 2011/0050736 | A1 | 3/2011 | Fan et al. | |
| 2011/0164016 | A1* | 7/2011 | Kang | G09G 3/3233 345/211 |
| 2012/0306843 | A1 | 12/2012 | Wang et al. | |

* cited by examiner

OLED PIXEL DRIVING CIRCUIT WITH COMPENSATION CIRCUITRY FOR UNIFORM BRIGHTNESS

CROSS-REFERENCE TO RELATED APPLICATIONS

This application claims priority to Taiwan Application Serial Number 103113080, filed Apr. 9, 2014, which is incorporated by reference herein in its entirety.

TECHNICAL FIELD

The present disclosure relates to a pixel driving circuit, and more particularly to a pixel driving circuit of organic light emitting diode.

BACKGROUND

Organic light emitting diode has gradually become the mainstream for displaying and also can be used in various applications. Generally, the conventional pixel driving circuit of organic light emitting diode is designed with two transistors and one capacitor, which are for controlling brightness of the organic light emitting diode.

However, because the manufacturing variation and the aging degradation of the light emitting diode, the current flowing through the light emitting diode may be unstable and consequentially the associated display panel may have brightness non-uniformity issue. That is, because these pixel driving circuits are electrically coupled to a voltage source through metal wires having impedances, the IR-drop may occur when the light emitting diodes are being driven by the voltage source to illuminate light. Thus, the pixel driving circuits may have different pixel currents and consequentially the light emitting diodes may have different brightness. As a result, the non-uniformity issue occurs.

SUMMARY

The present disclosure provides a pixel driving circuit, which includes a light emitting diode, a data writing unit, a first transistor, a first compensation unit, a second compensation unit and a second transistor. The light emitting diode includes a first terminal and a second terminal. The data writing unit is configured to receive a data signal. The first transistor includes a gate, a first terminal and a second terminal, wherein the gate of the first transistor is electrically coupled to the data writing unit. The first transistor is configured to determine a current flowing through from the first terminal to the second terminal of the light emitting diode according to a voltage difference between the gate and the first terminal of the first transistor. The first compensation unit is electrically coupled to the first transistor and configured to, with a cooperation of the first transistor, provide a current path from the gate of the first transistor to a first voltage source and a current path from the gate of the first transistor to a second voltage source. The second compensation unit includes a first capacitor electrically coupled to the gate of the first transistor. The second compensation unit is configured to provide a voltage transition to the gate of the first transistor through a voltage coupling of the first capacitor, and the voltage transition is substantially equal to a voltage difference between the first terminal and the second terminal of the light emitting diode. The second transistor is electrically coupled between the first voltage source and the second voltage source, wherein the second transistor is configured to turn on/off the current oath between the first voltage source and the second voltage source.

BRIEF DESCRIPTION OF THE DRAWINGS

The present disclosure will become more readily apparent to those ordinarily skilled in the art after reviewing the following detailed description and accompanying drawings, in which.

DETAILED DESCRIPTION OF PREFERRED EMBODIMENTS

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
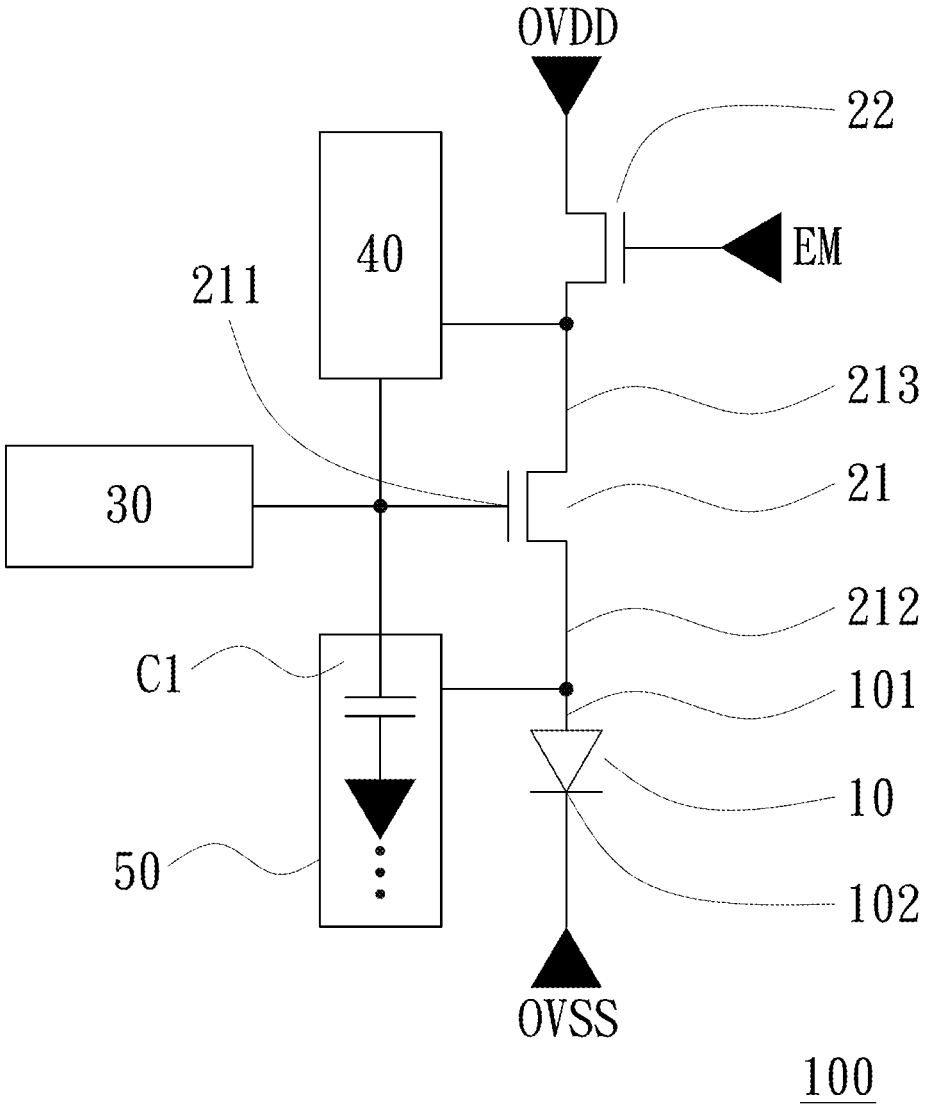
FIG. 1 is a schematic view of a pixel driving circuit in accordance with a first embodiment of the present disclosure.

FIG. 1 is a schematic view of a pixel driving circuit in accordance with a first embodiment of the present disclosure. As shown, the pixel driving circuit 100 in the present embodiment includes a light emitting diode 10, a first transistor 21, a second transistor 22, a data writing unit 30, a first compensation unit 40 and a second compensation unit 50. The light emitting diode 10 has a first terminal 101 and a second terminal 102; wherein herein the first terminal 101 of the light emitting diode 10 is referred to a positive terminal and the second terminal 102 is referred to a negative terminal. The first transistor 21 has a gate 211, a first terminal 212 and a second terminal 213; wherein the gate 211 is electrically coupled to the data writing unit 30. The first transistor 21 is configured to determine the current flowing through from the first terminal 101 to the second terminal 102 of the light emitting diode 10 according to the voltage difference between its gate 211 and its first terminal 212. The first compensation unit 40 is electrically coupled to the first transistor 21 and together with the first transistor 21 are configured to corporately provide a current path from the gate 211 to a first voltage source OVDD. The second compensation unit 50 includes a first capacitor C1 which is electrically coupled to the gate 211 of the first transistor 21. The second compensation unit 50 is configured to provide a voltage transition to the gate 211 of the transistor 21 through a voltage coupling of the first capacitor C1; wherein the voltage transition is substantially equal to the voltage difference between the first terminal 101 and the second terminal 102 of the light emitting diode 10. The second transistor 22, electrically coupled between the first voltage source OVDD and a second voltage source OVSS, is configured to turn on or off the current path between the first voltage source OVDD and the second voltage source OVSS.

Figure 2:
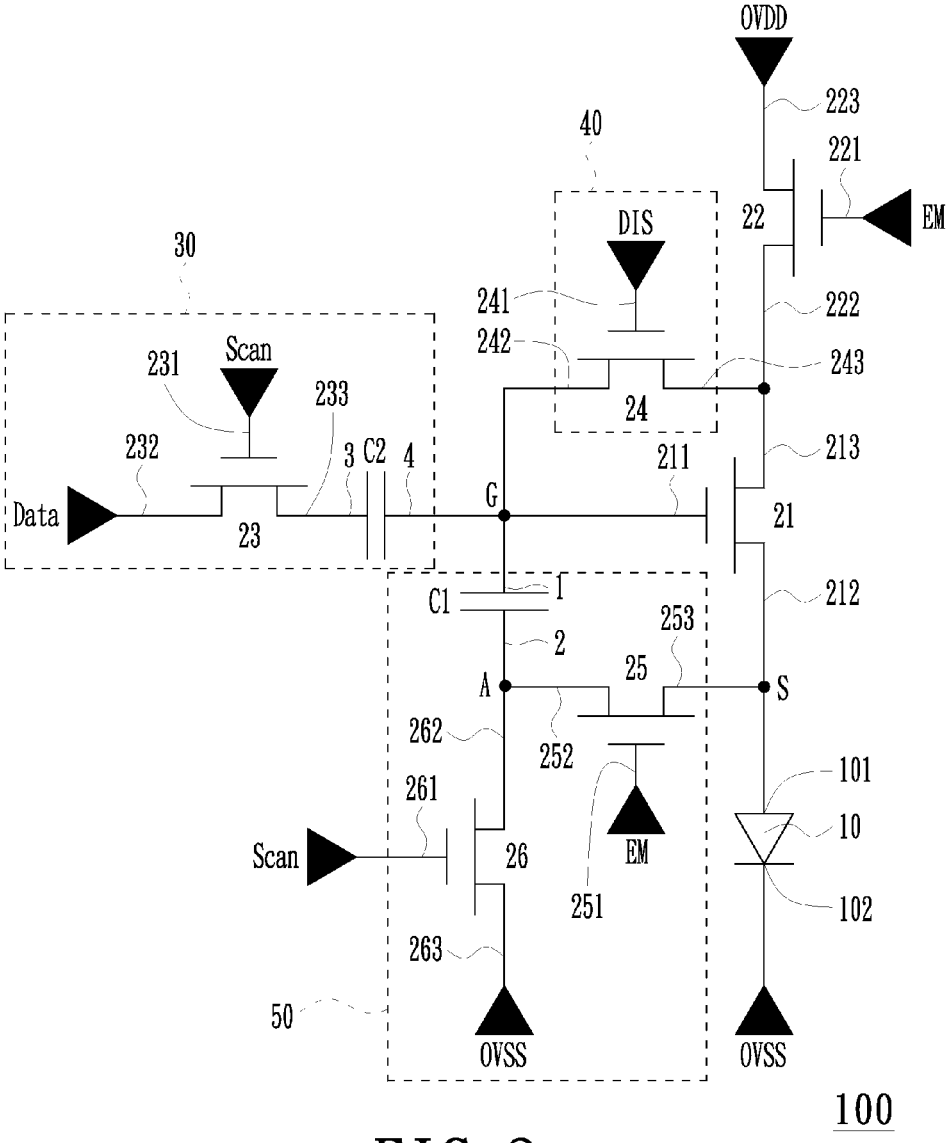
FIG. 2 is a schematic detailed view of the pixel driving circuit shown in FIG. 1.

FIG. 2 is a schematic detailed view of the pixel driving circuit 100 shown in FIG. 1. As shown in FIG. 2, the first terminal 101 of the light emitting diode 10 is electrically coupled to the first terminal 212 of the first transistor 21; and the second terminal 102 of the light emitting diode 10 is electrically coupled to the second voltage source OVSS. The first terminal 212 of the first transistor 21 is electrically coupled to the second voltage source OVSS through the light emitting diode 10. The data writing unit 30 includes a third transistor 23 and a second capacitor C2. The third transistor 23 has a control terminal 231, a first terminal 232 and a second terminal 233. The control terminal 231 of the third transistor 23 is configured to receive a first control signal Scan; and the first terminal 232 of the third transistor 23 is configured to receive a data signal Data. The second capacitor C2 has a first terminal 3 and a second terminal 4. The first terminal 3 of the second capacitor C2 is electrically coupled to the second terminal 233 of the third transistor 23; and the second terminal 4 of the second capacitor C2 is electrically coupled to the first terminal 1 of the first capacitor C1 and the gate 211 of the first transistor 21.

The first compensation unit 40 includes a fourth transistor 24. The fourth transistor 24 has a control terminal 241, a first terminal 242 and a second terminal 243. The control terminal 241 of the fourth transistor 24 is configured to receive a second control signal DIS; the first terminal 242 of the fourth transistor 24 is electrically coupled to the gate 211 of the first transistor 21; and the second terminal 243 of the fourth transistor 24 is electrically coupled to the second terminal 213 of the first transistor 21.

The second compensation unit 50 includes a fifth transistor 25 and a sixth transistor 26. The fifth transistor 25 has a control terminal 251, a first terminal 252 and a second terminal 253. The control terminal 251 of the fifth transistor 25 is configured to receive a third control signal EM; the first terminal 252 of the fifth transistor 25 is electrically coupled to the second terminal 2 of the first capacitor C1; and the second terminal 253 of the fifth transistor 25 is electrically coupled to the first terminal 212 of the first transistor 21. The sixth transistor 26 has a control terminal 261, a first terminal 262 and a second terminal 263. The control terminal 261 of the sixth transistor 26 is configured to receive the first control signal Scan; the first terminal 262 of the sixth transistor 26 is electrically coupled to the first terminal 252 of the fifth transistor 25; and the second terminal 263 of the sixth transistor 26 is electrically coupled to the second voltage source OVSS.

In addition, the second terminal 263 of the sixth transistor 26 and the second terminal 102 of the light emitting diode 10 may be electrically coupled to a same voltage level (for example, the second voltage source OVSS in the present embodiment), thereby preventing the emission current of the light emitting diode 10 from being affected by the IR drop (the reason will be described in detail later). The second transistor 22 has a control terminal 221, a first terminal 222 and a second terminal 223. The control terminal 221 of the second transistor 22 is configured to receive the third control signal EM; the first terminal 222 of the second transistor 22 is electrically coupled to the second terminal 213 of the first transistor 21; and the second terminal 223 of the second transistor 22 is electrically coupled to the first voltage source OVDD.

Figure 3:
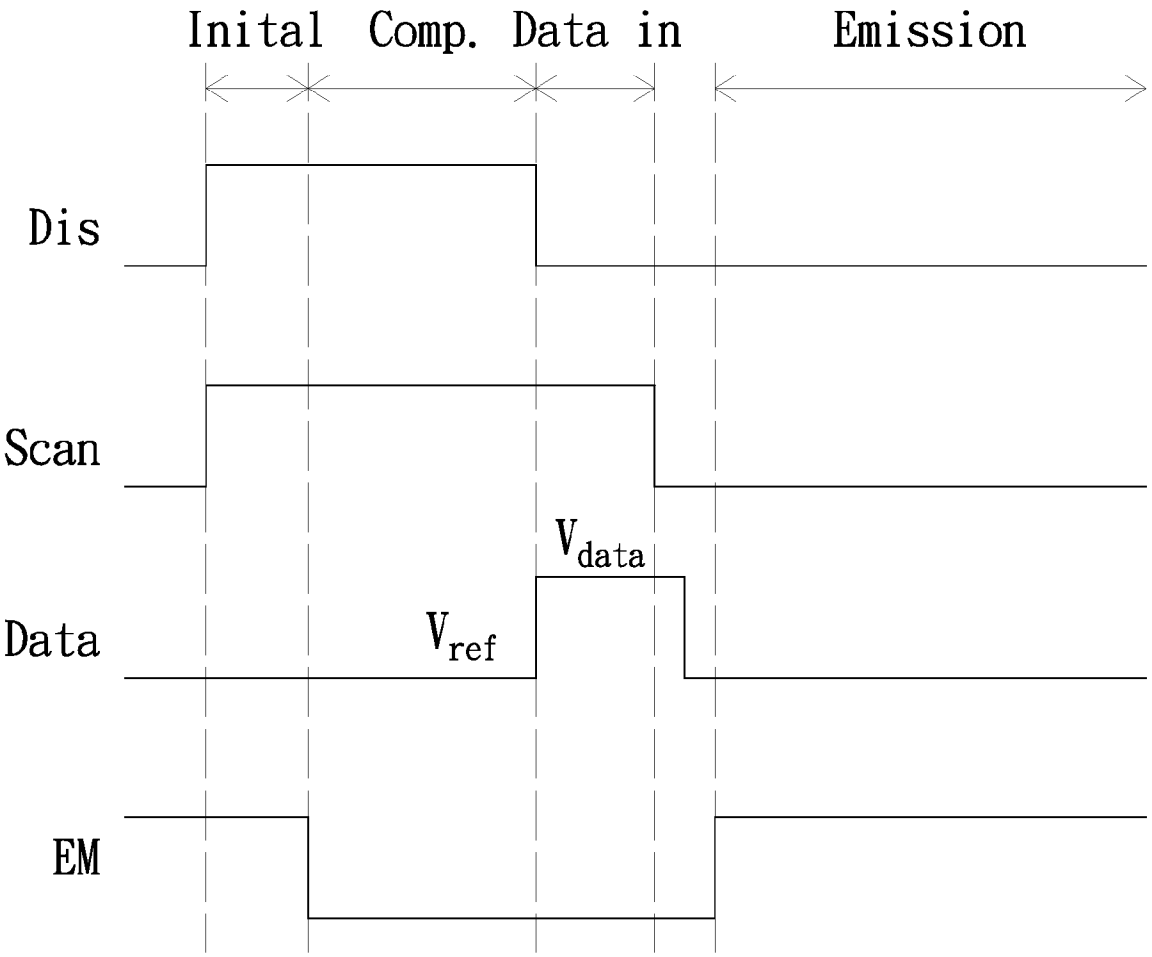
FIG. 3 is a timing diagram of the signals used in the pixel driving circuit in the first embodiment.

FIG. 3 is a timing diagram of the signals used in the pixel driving circuit 100 in the first embodiment. As shown, each cycle in the signal timing sequence of the pixel driving circuit in the embodiment of the present disclosure mainly includes four periods, which are an initial period Initial, a compensation period Comp., a data writing period Data in and an emission period Emission. Specifically, the first control signal Scan is configured to have a logic-high level for turning on the associated transistors in the initial period Initial, the compensation period Comp. and the data writing period Data in. The second control signal DIS is configured to have a logic-high level for turning on the associated transistors in the initial period Initial and the compensation period Comp. The third control signal EM is configured to have a logic-high level for turning on the associated transistors in the initial period Initial and the emission period Emission. The data signal Data is configured to have a data voltage level $V_{data}$ in the data writing period Data in and have a reference voltage level $V_{ref}$ in the non data writing period (that is, the initial period Initial, the compensation period Comp. and the emission period Emission). Moreover, by electrically coupling the first compensation unit 40 and the first transistor 21, the current path from the gate 211 of the first transistor 21 to the first voltage source OVDD is provided in the initial period Initial; and the current path from the gate 211 of the first transistor 21 to the second voltage source OVSS is provided in the compensation period Comp.

Please refer to FIGS. 2 and 3. In the pixel driving circuit 100 of the present embodiment, the second transistor 22, the third transistor 23, the fourth transistor 24, the fifth transistor 25 and the sixth transistor 26 are configured to turn on in the initial period Initial. Thus, in the initial period Initial, the voltage at the node G is substantially equal to OVDD; the voltage at the node S is substantially equal to $V_{oled}$+OVSS; and the voltage at the node A is smaller than $V_{oled}$+OVSS.

In addition, the third transistor 23, the fourth transistor 24 and the sixth transistor 26 are configured to turn on and the second transistor 22 and the fifth transistor 25 are configured to turn off in the compensation period Comp.; wherein the compensation period Comp. is after the initial period Initial. Because the second transistor 22 is turned off in the compensation period Comp., the voltage at the node G is discharged toward the second voltage source OVSS through the fourth transistor 24 and the first transistor 21 and accordingly the voltage difference between the nodes G and S is about to the threshold voltage $V_{th}$ of the first transistor 21, thereby achieving the compensation effect of the transistor threshold voltage $V_{th}$. Thus, in the compensation period Comp., the voltage at the node G is substantially equal to $V_{th}$+$V_{oled}$+OVSS; the voltage at the node S is substantially equal to $V_{oled}$+OVSS; and the voltage at the node A is substantially equal to OVSS.

In addition, the third transistor 23 and the sixth transistor 26 are configured to turn on and the second transistor 22, the fourth transistor 24 and the fifth transistor 25 are configured to turn off in the data writing period Data in; wherein the data writing period Data in is after the compensation period Comp. Because the third transistor 23 is configured to turn on in the data writing period Data in, the data signal Data is first supplied to the first terminal 3 of the second capacitor C2 and then written to the node G through the coupling effect of the second capacitor C2. In addition, because the sixth transistor 26 is configured to turn on in the data writing period Data in, the voltage at the node A is substantially equal to OVSS; the voltage at the node S is substantially equal to $V_{oled}$+OVSS; and the voltage at the node G is substantially equal to $V_{th}+V_{oled}+OVSS+a(V_{data}-V_{ref})$, wherein a is substantially equal to C2/C1+C2. In addition, the second transistor 22, the fourth transistor 24 and the fifth transistor 25 are turned off in the data writing period Data in.

In addition, the second transistor 22 and the fifth transistor 25 are configured to turn on and the third transistor 23, the fourth transistor 24 and the sixth transistor 26 are configured to turn off in the emission period Emission; wherein the emission period Emission is after the data writing period Data in. Because the fifth transistor 25 is configured to turn on in the emission period Emission, the voltage at the node A has a transition $V_{oled}$. That is, the voltage at the node A is changed to $V_{oled}+OVSS$ by being added with the crossing voltage $V_{oled}$ of the light emitting diode 10; the voltage at the node G is substantially equal to $V_{th}+V_{oled}+OVSS+a(V_{data}-V_{ref})+V_{oled}$; and the voltage at the node S is substantially equal to $V_{oled}+OVSS$. Generally, the emission current $I_{oled}$ of the light emitting diode 10 is obtained by: $I_{oled}=k/2(V_{GS}-V_{th})^2$; wherein k is a parameter of the first transistor 21, $V_{GS}$ is a voltage difference between the node G and the node S. Through the compensation, the emission current $I_{oled}$ in the present disclosure is substantially equal to $k/2[a(V_{data}-V_{ref})+V_{oled}]^2$. Thus, the emission current $I_{oled}$ in the present disclosure is no longer affected by the threshold voltage $V_{th}$ and can be compensated by the increased $V_{oled}$ resulted by the degradation of the light emitting diode 10. In summary, the emission current $I_{oled}$ of the light emitting diode 10 can be automatically adjusted by the transition of the crossing voltage $V_{oled}$ thereof; that is, the emission current $I_{oled}$ increases with the increasing of the crossing voltage $V_{oled}$ resulted by the degradation of the of the light emitting diode 10, and consequentially the degradation of the emission efficiency of light emitting diode 10 is compensated. In addition, it is noted that because the second terminal 263 of the sixth transistor 26 and the light emitting diode 10 are electrically coupled to the same voltage OVSS, the brightness non-uniformity issue resulted by the second voltage source OVSS on the entire light emitting diode display panel is prevented from occurring. For example, if the second terminal 263 of the sixth transistor 26 is electrically coupled to a third voltage source VSUS (not shown) instead of the second voltage source OVSS and the third voltage source VSUS and the second voltage source OVSS have different voltage values, the voltage at the node G will be substantially equal to $V_{th}+V_{oled}+OVSS+a(V_{data}-V_{ref})+V_{OLED}+OVSS-VSUS$. It is noted that the value of (OVSS−VSUS) is not zero and the emission current $I_{oled}$ is affected. Thus, by electrically coupling both of the second terminal 263 of the sixth transistor 26 and the light emitting diode 10 to the same voltage, the emission current $I_{oled}$ can be prevented from being affected by a serious IR drop.

Figure 4:
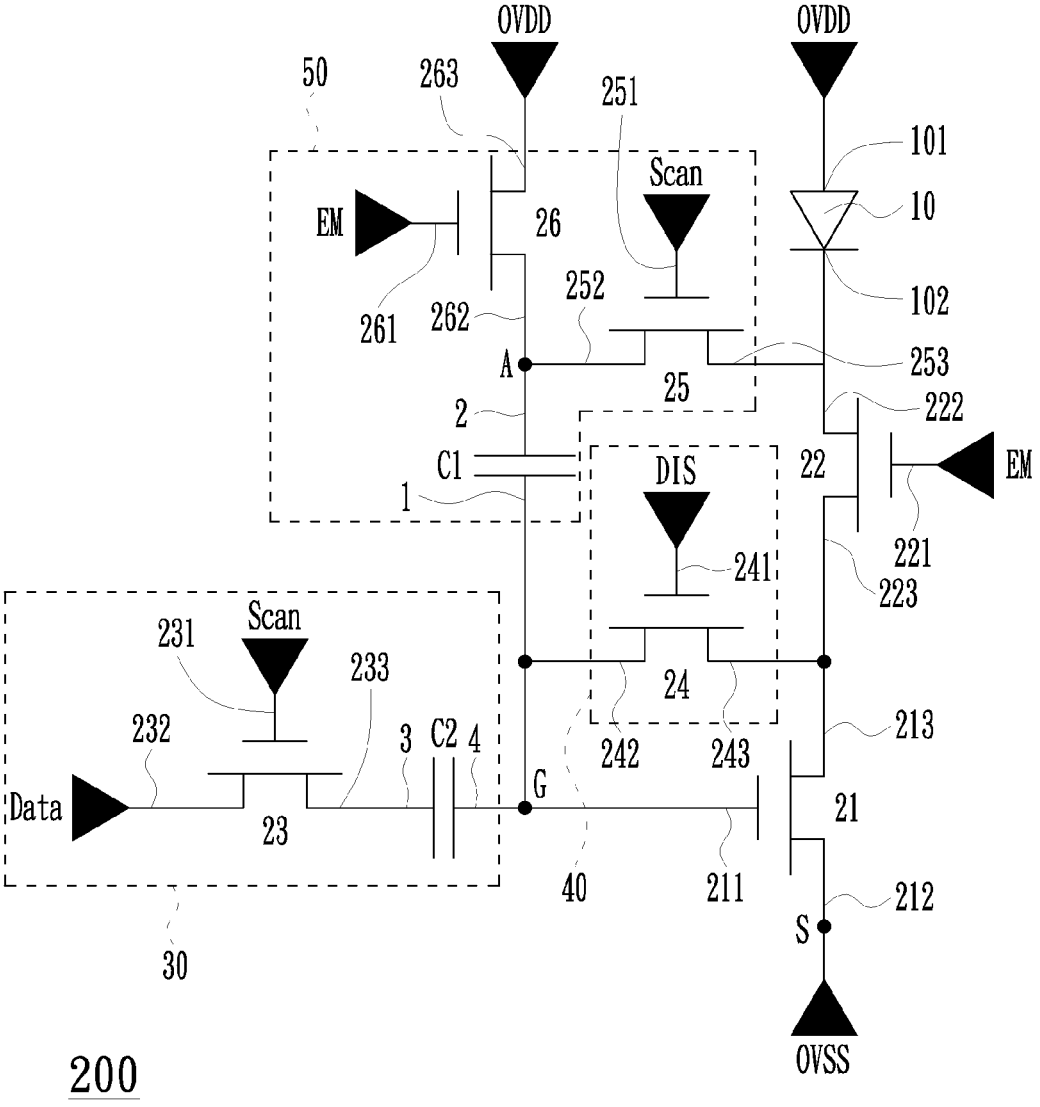
FIG. 4 is a schematic detailed view of a pixel driving circuit in accordance with a second embodiment of the present disclosure.

FIG. 4 is a schematic detailed view of a pixel driving circuit in accordance with a second embodiment of the present disclosure. It is noted that the pixel driving circuit 200 in the present embodiment has a circuit structure different with that of the pixel driving circuit 100 in the first embodiment; however, both have the same circuit operation and function and no redundant detail is to be given herein. Please refer to FIG. 4, the first terminal 101 of the light emitting diode 10 is electrically coupled to the first voltage source OVDD; and the second terminal 102 of the light emitting diode 10 is electrically coupled to the second terminal 213 of the first transistor 21 through the second transistor 22. The first terminal 212 of the first transistor 21 is electrically coupled to the second voltage source OVSS. The data writing unit 30 includes a third transistor 23 and a second capacitor C2. The third transistor 23 has a control terminal 231, a first terminal 232 and a second terminal 233. The control terminal 231 of the third transistor 23 is configured to receive a first control signal Scan; and the first terminal 232 of the third transistor 23 is configured to receive a data signal Data. The second capacitor C2 has a first terminal 3 and a second terminal 4. The first terminal 3 of the second capacitor C2 is electrically coupled to the second terminal 233 of the third transistor 23; and the second terminal 4 of the second capacitor C2 is electrically coupled to the first terminal 1 of the first capacitor C1 and the gate 211 of the first transistor 21. The first compensation unit 40 includes a fourth transistor 24. The fourth transistor 24 has a control terminal 241, a first terminal 242 and a second terminal 243. The control terminal 241 of the fourth transistor 24 is configured to receive a second control signal DIS; the first terminal 242 of the fourth transistor 24 is electrically coupled to the gate 211 of the first transistor 21; and the second terminal 243 of the fourth transistor 24 is electrically coupled to the second terminal 213 of the first transistor 21. The second compensation unit 50 includes a fifth transistor 25 and a sixth transistor 26. The fifth transistor 25 has a control terminal 251, a first terminal 252 and a second terminal 253. The control terminal 251 of the fifth transistor 25 is configured to receive the first control signal Scan; the first terminal 252 of the fifth transistor 25 is electrically coupled to the second terminal 2 of the first capacitor C1; and the second terminal 253 of the fifth transistor 25 is electrically coupled to the second terminal 102 of the light emitting diode 10. The sixth transistor 26 has a control terminal 261, a first terminal 262 and a second terminal 263. The control terminal 261 of the sixth transistor 26 is configured to receive the third control signal EM; the first terminal 262 of the sixth transistor 26 is electrically coupled to the first terminal 252 of the fifth transistor 25; and the second terminal 263 of the sixth transistor 26 is electrically coupled to the first voltage source OVDD. The second transistor 22 has a control terminal 221, a first terminal 222 and a second terminal 223. The control terminal 221 of the second transistor 22 is configured to receive the third control signal EM; the first terminal 222 of the second transistor 22 is electrically coupled to the second terminal 102 of the light emitting diode 10; and the second terminal 223 of the second transistor 22 is electrically coupled to the second terminal 213 of the first transistor 21.

It is noted that the timing diagram of FIG. 3 also applies to the pixel driving circuit 200 in the second embodiment, and no redundant detail is to be given herein. Please refer to FIGS. 3 and 4. In the pixel driving circuit 200 of the present embodiment, the second transistor 22, the third transistor 23, the fourth transistor 24, the fifth transistor 25 and the sixth transistor 26 are configured to turn on in the initial period Initial. In addition, the third transistor 23, the fourth transistor 24 and the fifth transistor 25 are configured to turn on and the second transistor 22 and the sixth transistor 26 are configured to turn off in the compensation period Comp.; wherein the compensation period Comp. is after the initial period Initial. In addition, the third transistor 23 and the fifth transistor 25 are configured to turn on and the second transistor 22, the fourth transistor 24 and the sixth transistor 26 are configured to turn off in the data writing period Data in; wherein the data writing period Data in is after the compensation period Comp. In addition, the second transistor 22 and the sixth transistor 26 are configured to turn on and the third transistor 23, the fourth transistor 24 and the fifth transistor 25 are turned off in the emission period Emission; wherein the emission period Emission is after the data writing period Data in. Even the pixel driving circuit 200 in the present embodiment and the pixel driving circuit 100 in the first embodiment have the same timing diagram, the sequence for turning on the transistors in the two embodiments are different due to two have different circuit structures; however, it is noted that the two pixel driving circuits still have the same circuit operation and function. The voltages at the nodes G, S and A in the initial period Initial, the compensation period Comp., the data writing period Data in and the emission period Emission will be described in the following. In the initial period Initial, the voltage at the node G is substantially equal to OVDD−$V_{oled}$; the voltage at the node S is substantially equal to OVSS; and the voltage at the node A is greater than OVDD−$V_{oled}$. In the compensation period Comp., the voltage at the node G is substantially equal to $V_{th}$+OVSS; the voltage at the node S is substantially equal to OVSS; and the voltage at the node A is substantially equal to OVDD−$V_{oled}$. In the data writing period Data in, the voltage at the node G is substantially equal to $V_{th}$+OVSS+$V_{data}$−$V_{ref}$; the voltage at the node S is substantially equal to OVSS; and the voltage at the node A is substantially equal to OVDD−$V_{oled}$. In the emission period Emission, the voltage at the node G is substantially equal to $V_{th}$+OVSS+$V_{data}$−$V_{ref}$+$V_{oled}$; the voltage at the node S is substantially equal to OVSS; and the voltage at the node A is substantially equal to OVDD. In addition, in the pixel driving circuits 100 and 200, the first voltage source OVDD is greater than the second voltage source OVSS; and each one of the transistors in the first and second embodiments is implemented with a P-type transistor.

Figure 5:
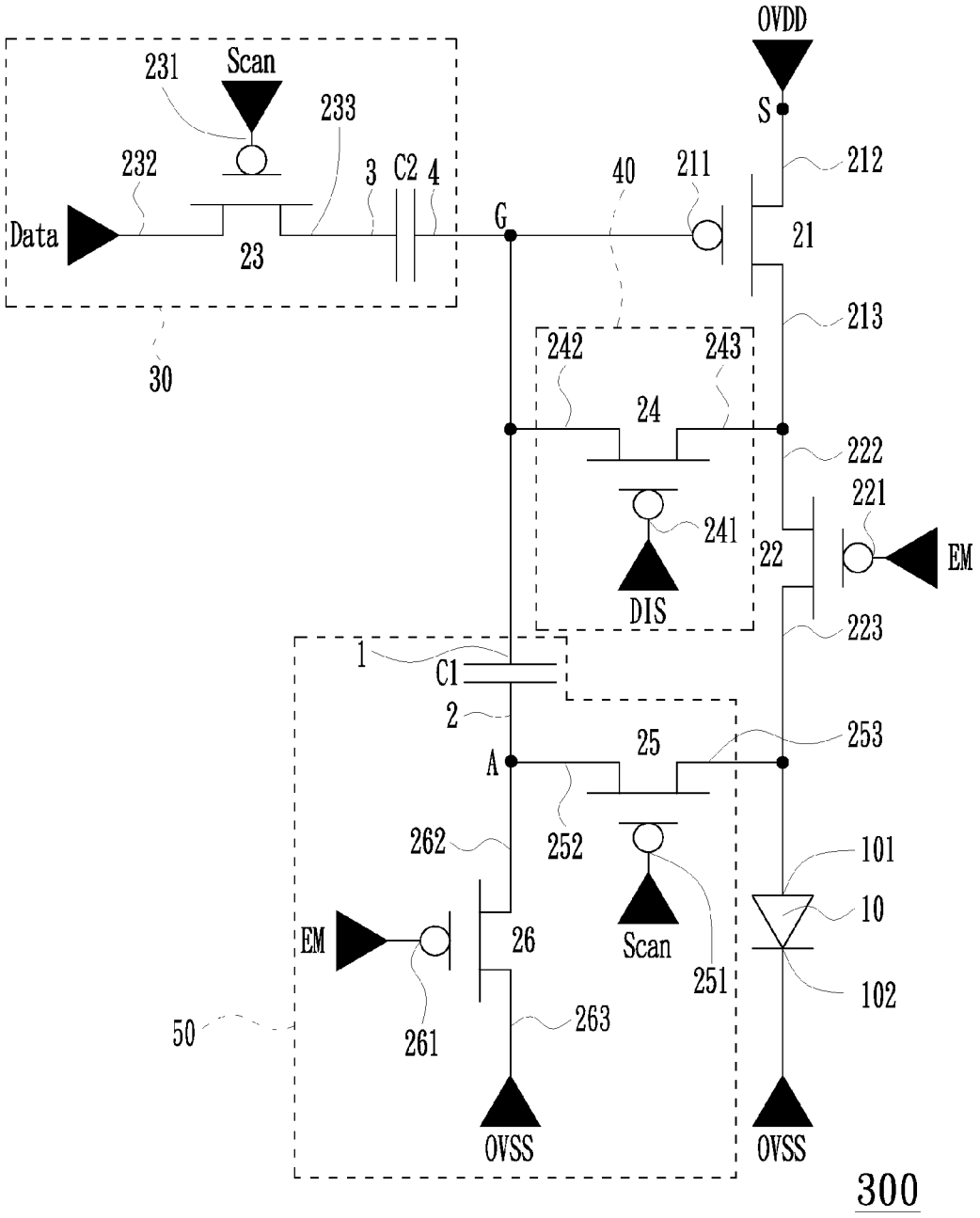
FIG. 5 is a schematic detailed view of a pixel driving circuit in accordance with a third embodiment of the present disclosure.

FIG. 5 is a schematic detailed view of a pixel driving circuit in accordance with a third embodiment of the present disclosure. It is noted that the pixel driving circuit 300 in the present embodiment has a circuit structure different with that of the pixel driving circuit 100 in the first embodiment; however, both have the same circuit operation and function and no redundant detail is to be given herein. Please refer to FIG. 5, the first terminal 101 of the light emitting diode 10 is electrically coupled to the second terminal 213 of the first transistor 21 through the second transistor 22; and the second terminal 102 of the light emitting diode 10 is electrically coupled to the second voltage source OVSS. The first terminal 212 of the first transistor 21 is electrically coupled to the first voltage source OVDD. The data writing unit 30 includes a third transistor 23 and a second capacitor C2. The third transistor 23 has a control terminal 231, a first terminal 232 and a second terminal 233. The control terminal 231 of the third transistor 23 is configured to receive a first control signal Scan; and the first terminal 232 of the third transistor 23 is configured to receive a data signal Data. The second capacitor C2 has a first terminal 3 and a second terminal 4. The first terminal 3 of the second capacitor C2 is electrically coupled to the second terminal 233 of the third transistor 23; and the second terminal 4 of the second capacitor C2 is electrically coupled to the first terminal 1 of the first capacitor C1 and the gate 211 of the first transistor 21. The first compensation unit 40 includes a fourth transistor 24. The fourth transistor 24 has a control terminal 241, a first terminal 242 and second terminal 243. The control terminal 241 of the fourth transistor 24 is configured to receive a second control signal DIS; the first terminal 242 of the fourth transistor 24 is electrically coupled to the gate 211 of the first transistor 21; and the second terminal 243 of the fourth transistor 24 is electrically coupled to the second terminal 213 of the first transistor 21. The second compensation unit 50 includes a fifth transistor 25 and a sixth transistor 26. The fifth transistor 25 has a control terminal 251, a first terminal 252 and a second terminal 253. The control terminal 251 of the fifth transistor 25 is configured to receive the first control signal Scan; the first terminal 252 of the fifth transistor 25 is electrically coupled to the second terminal 2 of the first capacitor C1; and the second terminal 253 of the fifth transistor 25 is electrically coupled to the first terminal 101 of the light emitting diode 10. The sixth transistor 26 has a control terminal 261, a first terminal 262 and a second terminal 263. The control terminal 261 of the sixth transistor 26 is configured to receive the third control signal EM; the first terminal 262 of the sixth transistor 26 is electrically coupled to the first terminal 252 of the fifth transistor 25; and the second terminal 263 of the sixth transistor 26 is electrically coupled to the second voltage source OVSS. The second transistor 22 has a control terminal 221, a first terminal 222 and a second terminal 223. The control terminal 221 of the second transistor 22 is configured to receive the third control signal EM; the first terminal 222 of the second transistor 22 is electrically coupled to the second terminal 213 of the first transistor 21; and the second terminal 223 of the second transistor 22 is electrically coupled to the first terminal 101 of the light emitting diode 10. It is noted that in the third embodiment, the first voltage source OVDD is greater than the second voltage source OVSS; and each one of the transistors in the third embodiment is implemented with a P-type transistor.

Figure 6:
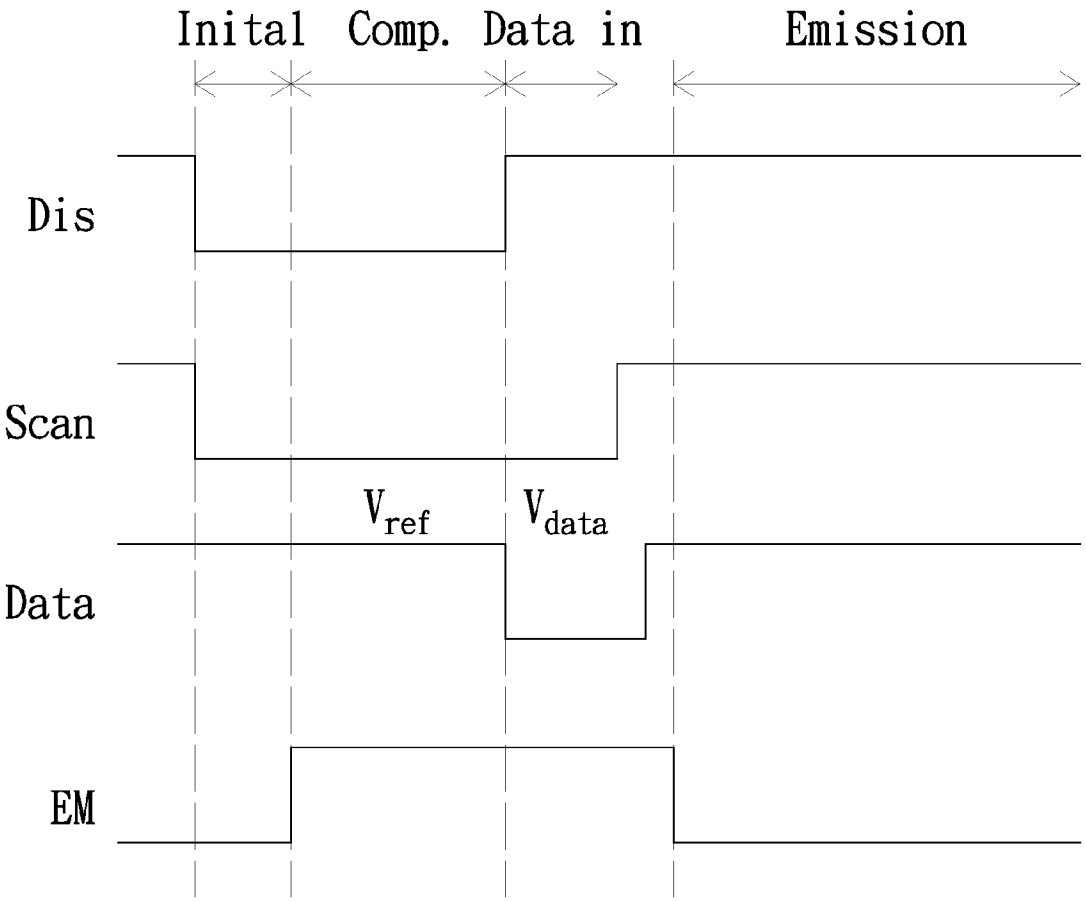
FIG. 6 is a timing diagram of the signals used in the pixel driving circuit in the third embodiment.

FIG. 6 is a timing diagram of the signals used in the pixel driving circuit 300 in the third embodiment. It is noted that FIG. 6 and FIG. 3 are similar except the gate signal, due to all the transistors in the third embodiment are implemented with the P-type transistors; thus, no redundant detail is to be given herein.

Please refer to FIGS. 5 and 6. In the pixel driving circuit 300 of the present embodiment, the second transistor 22, the third transistor 23, the fourth transistor 24, the fifth transistor 25 and the sixth transistor 26 are configured to turn on in the initial period Initial. In addition, the third transistor 23, the fourth transistor 24 and the fifth transistor 25 are configured to turn on and the second transistor 22 and the sixth transistor 26 are configured to turn off in the compensation period Comp.; wherein the compensation period Comp. is after the initial period Initial. In addition, the third transistor 23 and the fifth transistor 25 are configured to turn on and the second transistor 22, the fourth transistor 24 and the sixth transistor 26 are configured to turn off in the data writing period Data in; wherein the data writing period Data in is after the compensation period Comp. In addition, the second transistor 22 and the sixth transistor 26 are configured to turn on and the third transistor 23, the fourth transistor 24 and the fifth transistor 25 are configured to turn off in the emission period Emission; wherein the emission period Emission is after the data writing period Data in. Even the pixel driving circuit 300 in the present embodiment and the pixel driving circuit 100 in the first embodiment have the similar timing diagram, the sequence for turning on the transistors in the two embodiments are different due to two have different circuit structures; however, it is noted that the two pixel driving circuits still have the same circuit operation and function. The voltages at the nodes G, S and A in the initial period Initial, the compensation period Comp., the data writing period Data in and the emission period Emission will be described in the following. In the initial period Initial, the voltage at the node G is substantially equal to OVSS+$V_{oled}$; the voltage at the node S is substantially equal to OVDD; and the voltage at the node A is smaller than OVSS+$V_{oled}$. In the compensation period Comp., the voltage at the node G is substantially equal to OVDD−$V_{th}$; the voltage at the node S is substantially equal to OVDD; and the voltage at the node A is substantially equal to $V_{oled}$+OVSS. In the data writing period Data in, the voltage at the node G is substantially equal to OVDD−$V_{th}$+$V_{data}$−$V_{ref}$; the voltage at the node S is substantially equal to OVDD; and the voltage at the node A is substantially equal to $V_{oled}$+OVSS. In the emission period Emission, the voltage at the node G is substantially equal to OVDD−$V_{th}$+$V_{data}$−$V_{ref}$−$V_{oled}$; the voltage at the node S is substantially equal to OVDD; and the voltage at the node A is substantially equal to OVSS.

Figure 7:
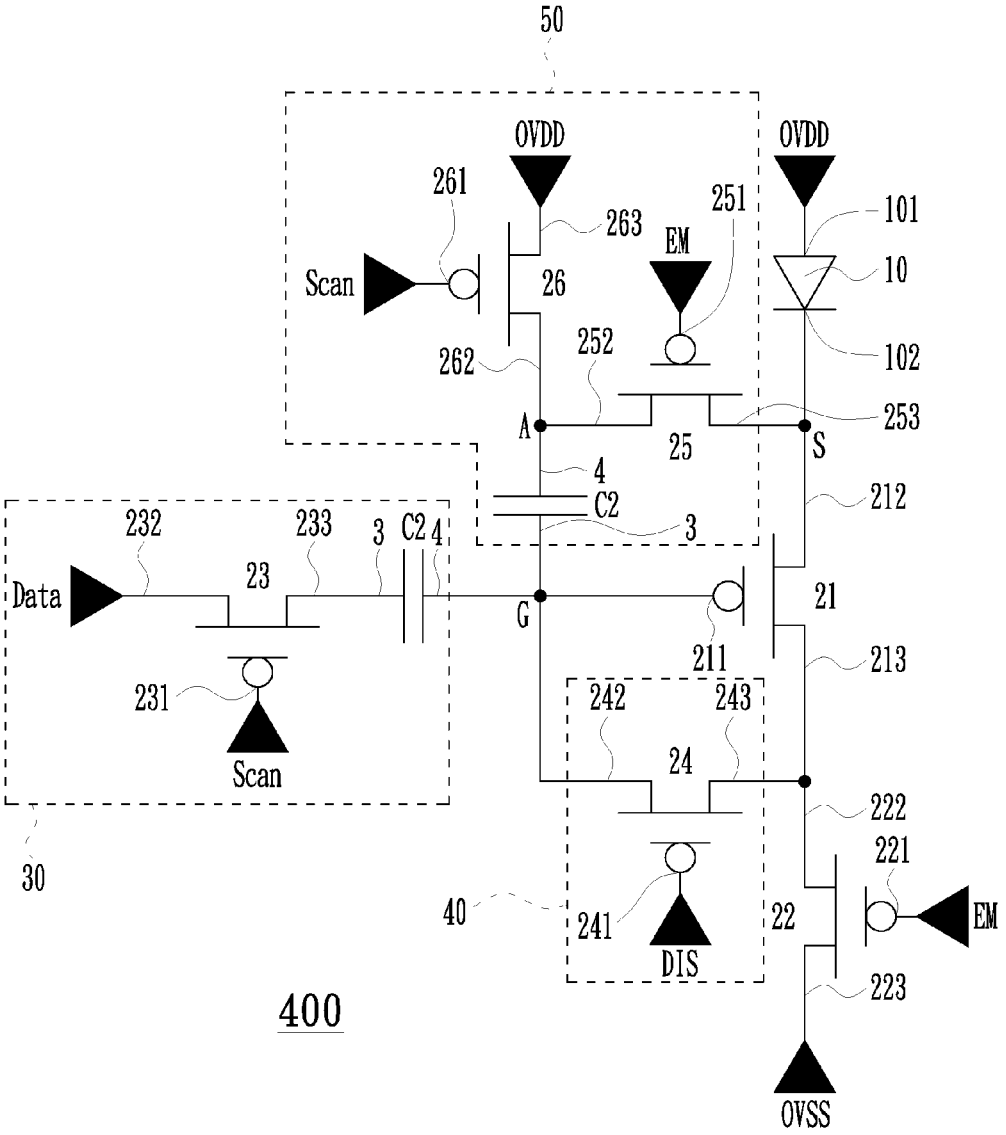
FIG. 7 is a schematic detailed view of a pixel driving circuit in accordance with a fourth embodiment of the present disclosure.

FIG. 7 is a schematic detailed view of a pixel driving circuit in accordance with a fourth embodiment of the present disclosure. It is noted that the pixel driving circuit 400 in the present embodiment has a circuit structure different with that of the pixel driving circuit 100 in the first embodiment; however, both have the same circuit operation and function and no redundant detail is to be given herein. Please refer to FIG. 7, the first terminal 101 of the light emitting diode 10 is electrically coupled to the first voltage source OVDD; and the second terminal 102 of the light emitting diode 10 is electrically coupled to the first terminal 212 of the first transistor 21. The second terminal 213 of the first transistor 21 is electrically coupled to the second voltage source OVSS through the second transistor 22. The data writing unit 30 includes a third transistor 23 and a second capacitor C2. The third transistor 23 has a control terminal 231, a first terminal 232 and a second terminal 233. The control terminal 231 of the third transistor 23 is configured to receive a first control signal Scan; and the first terminal 232 of the third transistor 23 is configured to receive a data signal Data. The second capacitor C2 has a first terminal 3 and a second terminal 4. The first terminal 3 of the second capacitor C2 is electrically coupled to the second terminal 233 of the third transistor 23; and the second terminal 4 of the second capacitor C2 is electrically coupled to the first terminal 1 of the first capacitor C1 and the gate 211 of the first transistor 21. The first compensation unit 40 includes a fourth transistor 24. The fourth transistor 24 has a control terminal 241, a first terminal 242 and a second terminal 243. The control terminal 241 of the fourth transistor 24 is configured to receive a second control signal DIS; the first terminal 242 of the fourth transistor 24 is electrically coupled to the gate 211 of the first transistor 21; and the second terminal 243 of the fourth transistor 24 is electrically coupled to the second terminal 213 of the first transistor 21. The second compensation unit 50 includes a fifth transistor 25 and a sixth transistor 26. The fifth transistor 25 has a control terminal 251, a first terminal 252 and a second terminal 253. The control terminal 251 of the fifth transistor 25 is configured to receive a third control signal EM; the first terminal 252 of the fifth transistor 25 is electrically coupled to the second terminal 2 of the first capacitor C1; and the second terminal 253 of the fifth transistor 25 is electrically coupled to the second terminal 102 of the light emitting diode 10. The sixth transistor 26 has a control terminal 261, a first terminal 262 and a second terminal 263. The control terminal 261 of the sixth transistor 26 is configured to receive the first control signal Scan; the first terminal 262 of the sixth transistor 26 is electrically coupled to the first terminal 252 of the fifth transistor 25; and the second terminal 263 of the sixth transistor 26 is electrically coupled to the first voltage source OVDD. The second transistor 22 has a control terminal 221, a first terminal 222 and a second terminal 223. The control terminal 221 of the second transistor 22 is configured to receive the third control signal EM; the first terminal 222 of the second transistor 22 is electrically coupled to the second terminal 213 of the first transistor 21; and the second terminal 223 of the second transistor 22 is electrically coupled to the second voltage source OVSS. It is noted that in the fourth embodiment, the first voltage source OVDD is greater than the second voltage source OVSS; and each one of the transistors in the fourth embodiment is implemented with a P-type transistor.

It is noted that the timing diagram of FIG. 6 also applies to the pixel driving circuit 400 in the fourth embodiment, and no redundant detail is to be given herein. Please refer to FIGS. 6 and 7. In the pixel driving circuit 400, the second transistor 22, the third transistor 23, the fourth transistor 24, the fifth transistor 25 and the sixth transistor 26 are configured to turn on in the initial period Initial. In addition, the third transistor 23, the fourth transistor 24 and the sixth transistor 26 are configured to turn on and the second transistor 22 and the fifth transistor 25 are turned off in the compensation period Comp.; wherein the compensation period Comp. is after the initial period Initial. In addition, the third transistor 23 and the sixth transistor 26 are configured to turn on and the second transistor 22, the fourth transistor 24 and the fifth transistor 25 are configured to turn off in the data writing period Data in; wherein the data writing period Data in is after the compensation period Comp. In addition, the second transistor 22 and the fifth transistor 25 are configured to turn on and the third transistor 23, the fourth transistor 24 and the sixth transistor 26 are configured to turn off in the emission period Emission; wherein the emission period Emission is after the data writing period Data in. Even the pixel driving circuit 400 in the present embodiment and the pixel driving circuit 300 in the third embodiment have the same timing diagram, the sequence for turning on the transistors in the two embodiments are different due to two have different circuit structures; however, it is noted that the two pixel driving circuits still have the same circuit operation and function. The voltages at the nodes G, S and A in the initial period Initial, the compensation period Comp., the data writing period Data in and the emission period Emission will be described in the following. In the initial period Initial, the voltage at the node G is substantially equal to OVSS; the voltage at the node S is substantially equal to OVDD−$V_{oled}$; and the voltage at the node A is greater than OVDD−$V_{oled}$. In the compensation period Comp., the voltage at the node G is substantially equal to OVDD−$V_{oled}$−$V_{th}$; the voltage at the node S is substantially equal to OVDD−$V_{oled}$; and the voltage at the node A is substantially equal to OVDD. In the data writing period Data in, the voltage at the node G is substantially equal to OVDD−$V_{oled}$−$V_{th}$+a($V_{data}$−$V_{ref}$); the voltage at the node S is substantially equal to OVDD−$V_{oled}$; and the voltage at the node A is substantially equal to OVDD. In the emission period Emission, the voltage at the node G is substantially equal to OVDD−$V_{oled}$−$V_{th}$+a($V_{data}$−$V_{ref}$)−$V_{oled}$; the voltage at the node S is substantially equal to OVDD−$V_{oled}$; and the voltage at the node A is substantially equal to OVDD−$V_{oled}$.

In summary, by designing a pixel driving circuit comprising six transistors, two capacitors and a light emitting element, the display panel employing the pixel driving circuit of the present disclosure can improve the non-uniformity of display panel and the emission efficiency degradation issue; and consequentially the display quality is improved. In addition, it is noted that the light emitting diode employed in the embodiments of the present disclosure can be an organic light emitting diode.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A pixel driving circuit, comprising:

a light emitting diode, comprising a first terminal and a second terminal;

a data writing unit, configured to receive a data signal;

a first transistor, comprising a gate, a first terminal and a second terminal, wherein the gate of the first transistor is electrically coupled to the data writing unit, the first transistor is configured to determine a current flowing through from the first terminal to the second terminal of the light emitting diode according to a voltage difference between the gate and the first terminal of the first transistor;

a first compensation unit, electrically coupled to the first transistor and configured to, with a cooperation of the first transistor, provide a current path from the gate of the first transistor to a first voltage source and a current path from the gate of the first transistor to a second voltage source;

a second compensation unit, comprising a first capacitor electrically coupled to the gate of the first transistor, wherein the second compensation unit is configured to provide a voltage transition to the gate of the first transistor through a voltage coupling of the first capacitor, and the voltage transition is substantially equal to a voltage difference between the first terminal and the second terminal of the light emitting diode; and a second transistor, electrically coupled between the first voltage source and the second voltage source, wherein the second transistor is configured to turn on/off the current path between the first voltage source and the second voltage source.

2. The pixel driving circuit according to claim 1, wherein the first terminal of the light emitting diode is electrically coupled to the first terminal of the first transistor, and the second terminal of the light emitting diode is electrically coupled to the second voltage source;

wherein the first terminal of the first transistor is electrically coupled to the second voltage source through the light emitting diode;

wherein the data writing unit comprises a third transistor and a second capacitor, the third transistor comprises a control terminal, a first terminal and a second terminal, the control terminal of the third transistor is configured to receive a first control signal, and the first terminal of the third transistor is configured to receive the data signal, a first terminal of the second capacitor is electrically coupled to the second terminal of the third transistor, and a second terminal of the second capacitor is electrically coupled to a first terminal of the first capacitor and the gate of the first transistor;

wherein the first compensation unit comprises a fourth transistor, the fourth transistor comprises a control terminal, a first terminal and a second terminal, the control terminal of the fourth transistor is configured to receive a second control signal, the first terminal of the fourth transistor is electrically coupled to the gate of the first transistor, and the second terminal of the fourth transistor is electrically coupled to the second terminal of the first transistor;

wherein the second compensation unit comprises a fifth transistor and a sixth transistor, the fifth transistor comprises a control terminal, a first terminal and a second terminal, the control terminal of the fifth transistor is configured to receive a third control signal, the first terminal of the fifth transistor is electrically coupled to a second terminal of the first capacitor, and the second terminal of the fifth transistor is electrically coupled to the first terminal of the first transistor, the sixth transistor comprises a control terminal, a first terminal and a second terminal, the control terminal of the sixth transistor is configured to receive the first control signal, the first terminal of the sixth transistor is electrically coupled to the first terminal of the fifth transistor, and the second terminal of the sixth transistor is electrically coupled to the second voltage source, wherein the second transistor comprises a gate, a first terminal and a second terminal, the gate of the second transistor is configured to receive the third control signal, the first terminal of the second transistor is electrically coupled to the second terminal of the first transistor, and the second terminal of the second transistor is electrically coupled to the first voltage source.

3. The pixel driving circuit according to claim 2, wherein the second transistor, the third transistor, the fourth transistor, the fifth transistor and the sixth transistor are configured to turn on in an initial period; the third transistor, the fourth transistor and the sixth transistor are configured to turn on and the second transistor and the fifth transistor are configured to turn off in a compensation period, wherein the compensation period is after the initial period; the third transistor and the sixth transistor are configured to turn on and the second transistor, the fourth transistor and the fifth transistor are configured to turn off in a data writing period, wherein the data writing period is after the compensation period; the second transistor and the fifth transistor are configured to turn on and the third transistor, the fourth transistor and the sixth transistor are configured to turn off in an emission period, wherein the emission period is after the data writing period.

4. The pixel driving circuit according to claim 3, wherein the first voltage source is greater than the second voltage source, and the first transistor, the second transistor, the third transistor, the fourth transistor, the fifth transistor and the sixth transistor are N-type transistors.

5. The pixel driving circuit according to claim 2, wherein the first voltage source is greater than the second voltage source, and the first transistor, the second transistor, the third transistor, the fourth transistor, the fifth transistor and the sixth transistor are N-type transistors.

6. The pixel driving circuit according to claim 1, wherein the first terminal of the light emitting diode is electrically coupled to the first voltage source, and the second terminal of the light emitting diode is electrically coupled to the second terminal of the first transistor through the second transistor, wherein the first terminal of the first transistor is electrically coupled to the second voltage source, wherein the data writing unit comprises a third transistor and a second capacitor, the third transistor comprises a control terminal, a first terminal and a second terminal, the control terminal of the third transistor is configured to receive a first control signal, and the first terminal of the third transistor is configured to receive the data signal, a first terminal of the second capacitor is electrically coupled to the second terminal of the third transistor, and a second terminal of the second capacitor is electrically coupled to a first terminal of the first capacitor and the gate of the first transistor, wherein the first compensation unit comprises a fourth transistor, the fourth transistor comprises a control terminal, a first terminal and a second terminal, the control terminal of the fourth transistor is configured to receive a second control signal, the first terminal of the fourth transistor is electrically coupled to the gate of the first transistor, and the second terminal of the fourth transistor is electrically coupled to the second terminal of the first transistor, wherein the second compensation unit comprises a fifth transistor and a sixth transistor, the fifth transistor comprises a control terminal, a first terminal and a second terminal, the control terminal of the fifth transistor is configured to receive the first control signal, the first terminal of the fifth transistor is electrically coupled to a second terminal of the first capacitor, and the second terminal of the fifth transistor is electrically coupled to the second terminal of the light emitting diode, the sixth transistor comprises a control terminal, a first terminal and a second terminal, the control terminal of the sixth transistor is configured to receive a third control signal, the first terminal of the sixth transistor is electrically coupled to the first terminal of the fifth transistor, and the second terminal of the sixth transistor is electrically coupled to the first voltage source, wherein the second transistor comprises a control terminal, a first terminal and a second terminal, the control terminal of the second transistor is configured to receive the third control signal, the first terminal of the second transistor is electrically coupled to the second terminal of the light emitting diode, and the second terminal of the second transistor is electrically coupled to the second terminal of the first transistor.

7. The pixel driving circuit according to claim 6, wherein the second transistor, the third transistor, the fourth transistor, the fifth transistor and the sixth transistor are configured to turn on in an initial period; the third transistor, the fourth transistor and the fifth transistor are configured to turn on and the second transistor and the sixth transistor are turned off in a compensation period, wherein the compensation period is after the initial period; the third transistor and the fifth transistor are configured to turn on and the second transistor, the fourth transistor and the sixth transistor are configured to turn off in a data writing period, wherein the data writing period is after the compensation period; the second transistor and the sixth transistor are configured to turn on and the third transistor, the fourth transistor and the fifth transistor are configured to turn off in an emission period, wherein the emission period is after the data writing period.

8. The pixel driving circuit according to claim 7, wherein the first voltage source is greater than the second voltage source, and the first transistor, the second transistor, the third transistor, the fourth transistor, the fifth transistor and the sixth transistor are N-type transistors.

9. The pixel driving circuit according to claim 6, wherein the first voltage source is greater than the second voltage source, and the first transistor, the second transistor, the third transistor, the fourth transistor, the fifth transistor and the sixth transistor are N-type transistors.

10. The pixel driving circuit according to claim 1, wherein the first terminal of the light emitting diode is electrically coupled to the second terminal of the first transistor through the second transistor, and the second terminal of the light emitting diode is electrically coupled to the second voltage source, wherein the first terminal of the first transistor is electrically coupled to the first voltage source, wherein the data writing unit comprises a third transistor and a second capacitor, the third transistor comprises a control terminal, a first terminal and a second terminal, the control terminal of the third transistor is configured to receive a first control signal, and the first terminal of the third transistor is configured to receive the data signal, a first terminal of the second capacitor is electrically coupled to the second terminal of the third transistor, and a second terminal of the second capacitor is electrically coupled to a first terminal of the first capacitor and the gate of the first transistor, wherein the first compensation unit comprises a fourth transistor, the fourth transistor comprises a control terminal, a first terminal and second terminal, the control terminal of the fourth transistor is configured to receive a second control signal, the first terminal of the fourth transistor is electrically coupled to the gate of the first transistor, and the second terminal of the fourth transistor is electrically coupled to the second terminal of the first transistor, wherein the second compensation unit comprises a fifth transistor and a sixth transistor, the fifth transistor comprises a control terminal, a first terminal and a second terminal, the control terminal of the fifth transistor is configured to receive the first control signal, the first terminal of the fifth transistor is electrically coupled to a second terminal of the first capacitor, and the second terminal of the fifth transistor is electrically coupled to the first terminal of the light emitting diode, the sixth transistor comprises a control terminal, a first terminal and a second terminal, the control terminal of the sixth transistor is configured to receive a third control signal, the first terminal of the sixth transistor is electrically coupled to the first terminal of the fifth transistor, and the second terminal of the sixth transistor is electrically coupled to the second voltage source, wherein the second transistor comprises a control terminal, a first terminal and a second terminal, the control terminal of the second transistor is configured to receive the third control signal, the first terminal of the second transistor is electrically coupled to the second terminal of the first transistor, and the second terminal of the second transistor is electrically coupled to the first terminal of the light emitting diode.

11. The pixel driving circuit according to claim 10, wherein the second transistor, the third transistor, the fourth transistor, the fifth transistor and the sixth transistor are configured to turn on in an initial period; the third transistor, the fourth transistor and the fifth transistor are configured to turn on and the second transistor and the sixth transistor are turned off in a compensation period, wherein the compensation period is after the initial period; the third transistor and the fifth transistor are configured to turn on and the second transistor, the fourth transistor and the sixth transistor are configured to turn off in a data writing period, wherein the data writing period is after the compensation period; the second transistor and the sixth transistor are configured to turn on and the third transistor, the fourth transistor and the fifth transistor are configured to turn off in an emission period, wherein the emission period is after the data writing period.

12. The pixel driving circuit according to claim 11, wherein the first voltage source is greater than the second voltage source, and the first transistor, the second transistor, the third transistor, the fourth transistor, the fifth transistor and the sixth transistor are P-type transistors.

13. The pixel driving circuit according to claim 10, wherein the first voltage source is greater than the second voltage source, and the first transistor, the second transistor, the third transistor, the fourth transistor, the fifth transistor and the sixth transistor are P-type transistors.

14. The pixel driving circuit according to claim 1, wherein the first terminal of the light emitting diode is electrically coupled to the to the first voltage source, and the second terminal of the light emitting diode is electrically coupled to the first terminal of the first transistor, wherein the second terminal of the first transistor is electrically coupled to the second voltage source through the second transistor, wherein the data writing unit comprises a third transistor and a second capacitor, the third transistor comprises a control terminal, a first terminal and a second terminal, the control terminal of the third transistor is configured to receive a first control signal, and the first terminal of the third transistor is configured to receive the data signal, a first terminal of the second capacitor is electrically coupled to the second terminal of the third transistor, and a second terminal of the second capacitor is electrically coupled to a first terminal of the first capacitor and the gate of the first transistor, wherein the first compensation unit comprises a fourth transistor, the fourth transistor comprises a control terminal, a first terminal and a second terminal, the control terminal of the fourth transistor is configured to receive a second control signal, the first terminal of the fourth transistor is electrically coupled to the gate of the first transistor, and the second terminal of the fourth transistor is electrically coupled to the second terminal of the first transistor, wherein the second compensation unit comprises a fifth transistor and a sixth transistor, the fifth transistor comprises a control terminal, a first terminal and a second terminal, the control terminal of the fifth transistor is configured to receive a third control signal, the first terminal of the fifth transistor is electrically coupled to a second terminal of the first capacitor, and the second terminal of the fifth transistor is electrically coupled to the second terminal of the light emitting diode, the sixth transistor comprises a control terminal, a first terminal and a second terminal, the control terminal of the sixth transistor is configured to receive the first control signal, the first terminal of the sixth transistor is electrically coupled to the first terminal of the fifth transistor, and the second terminal of the sixth transistor is electrically coupled to the first voltage source, wherein the second transistor comprises a control terminal, a first terminal and a second terminal, the control terminal of the second transistor is configured to receive the third control signal, the first terminal of the second transistor is electrically coupled to the second terminal of the first transistor, and the second terminal of the second transistor is electrically coupled to the second voltage source.

15. The pixel driving circuit according to claim 14, wherein the second transistor, the third transistor, the fourth transistor, the fifth transistor and the sixth transistor are configured to turn on in an initial period; the third transistor, the fourth transistor and the sixth transistor are configured to turn on and the second transistor and the fifth transistor are configured to turn off in a compensation period, wherein the compensation period is after the initial period; the third transistor and the sixth transistor are configured to turn on and the second transistor, the fourth transistor and the fifth transistor are configured to turn off in a data writing period, wherein the data writing period is after the compensation period; the second transistor and the fifth transistor are configured to turn on and the third transistor, the fourth transistor and the sixth transistor are configured to turn off in an emission period, wherein the emission period is after the data writing period.

16. The pixel driving circuit according to claim 15, wherein the first voltage source is greater than the second voltage source, and the first transistor, the second transistor, the third transistor, the fourth transistor, the fifth transistor and the sixth transistor are P-type transistors.

17. The pixel driving circuit according to claim 14, wherein the first voltage source is greater than the second voltage source, and the first transistor, the second transistor, the third transistor, the fourth transistor, the fifth transistor and the sixth transistor are P-type transistors.

* * * * *